United States Patent [19]

Trowbridge et al.

[11] Patent Number: 5,045,984

[45] Date of Patent: Sep. 3, 1991

[54] MOUNTING DEVICE FOR RELEASABLE SECUREMENT TO A PANEL

[76] Inventors: Charles Trowbridge, 368 Thompson Mill Rd., New Hope, Pa. 18938; John Rodgers, 2152 Bethel Rd., Lansdale, Pa. 19446

[21] Appl. No.: 565,533

[22] Filed: Aug. 10, 1990

[51] Int. Cl.[5] ..... F21V 7/70

[52] U.S. Cl. ..... 362/365; 362/368; 362/147; 411/508; 411/913; 248/271

[58] Field of Search ..... 362/145, 147, 148, 150, 362/364, 365, 366, 368, 370, 226; 248/27.1, 27.3, 231.9, 231.91; 411/508, 509, 510, 913

[56] References Cited

U.S. PATENT DOCUMENTS

| | | | |
|---|---|---|---|
| 3,991,446 | 11/1976 | Mooney et al. | 411/508 |
| 4,048,491 | 9/1977 | Wessman | 362/364 |
| 4,393,551 | 7/1983 | Wollar et al. | 411/509 |
| 4,653,708 | 3/1987 | Rich | 248/27.1 |
| 4,673,149 | 6/1987 | Grofe et al. | 248/27.1 |
| 4,733,339 | 3/1988 | Kelsall | 362/366 |
| 4,739,460 | 4/1988 | Kelsall | 362/365 |
| 4,763,231 | 8/1988 | Houplain | 362/368 |

FOREIGN PATENT DOCUMENTS

| | | | |
|---|---|---|---|
| 226819 | 4/1963 | Austria | 362/365 |

*Primary Examiner*—Ira S. Lazarus
*Assistant Examiner*—D. M. Cox
*Attorney, Agent, or Firm*—Caesar, Rivise, Bernstein, Cohen & Pokotilow, Ltd.

[57] ABSTRACT

A device arranged to be releasably mounting within a hole in a panel, e.g., a ceiling, to hold a lamp bulb and associated reflector or any other member therein. The device comprises a tubular body, a flange for engaging one side of the panel, and plural, equidistantly, peripherally-spaced, flexible arms for engaging the other side of the panel. Each arm extends outward from the body and is moveable from an extended position to a retracted position and vice versa. The arms are moved from the extended position to the retracted position when the body is pushed into the hole while being twisted about its longitudinal central axis in one rotational direction. The arms automatically move back to the extended position when the device is in place to hold the device securely within the hole. The device can be removed by pulling it out of the hole while twisting it about its longitudinal axis in the same rotational direction as used to insert it, whereupon the arms flex to the retracted position. An adaptor is provided for mounting in the device to hold different sized members, e.g., bulbs and reflectors.

44 Claims, 2 Drawing Sheets

3
FIG. 1
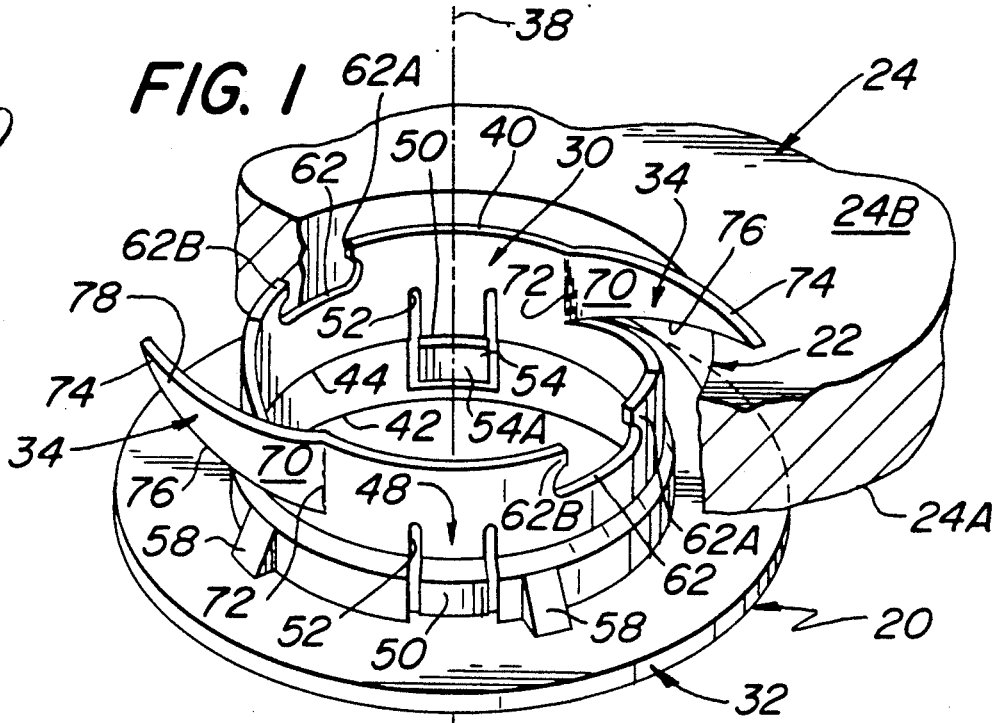
PRIOR ART
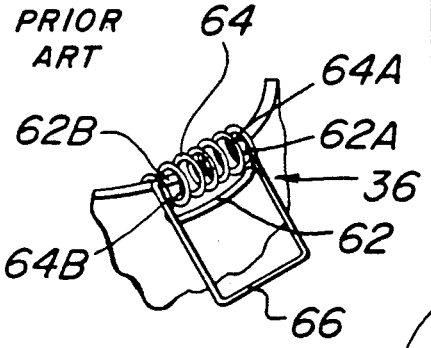
FIG. 1A
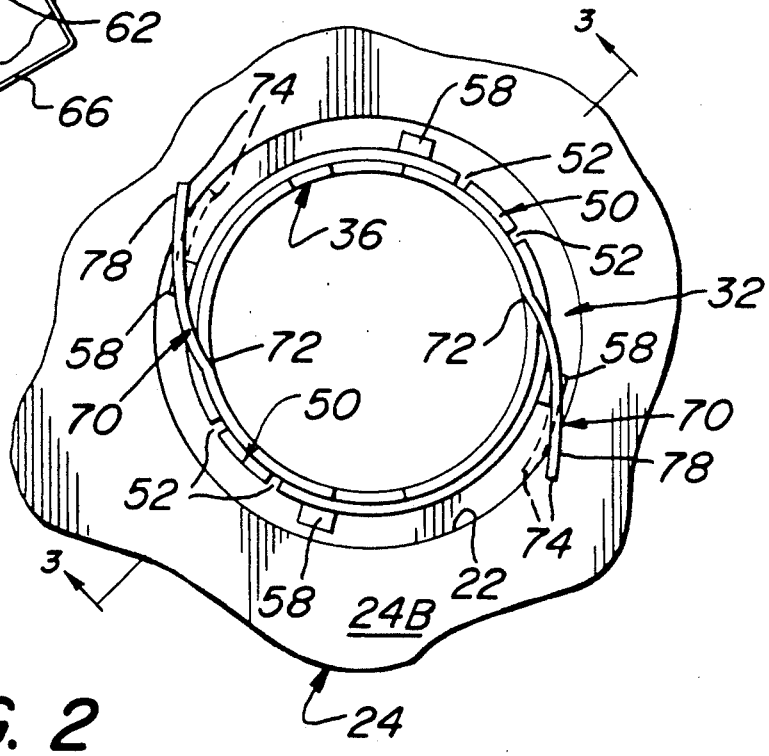
FIG. 2

MOUNTING DEVICE FOR RELEASABLE SECUREMENT TO A PANEL

BACKGROUND OF THE INVENTION

This invention relates generally to mounting devices arranged for releasable securement to a structural panel, e.g., a ceiling, wall, etc., for supporting various types of members, e.g., an electric bulb and reflector, therein.

Various types of devices are commercially available for holding a 50 or 70 watt, 12 volt electric lamp bulb and an associated reflector in a structural panel, such as a ceiling. One such device basically comprises a hollow, tube-like body for releasably mounting a bulb-reflector assembly therein so that the bulb and reflector may direct light out of the panel in which the device is mounted. The body is in the form of a circular sidewall having a lower end from which a peripheral flange projects. The flange serves to engage the outer surface of the panel contiguous with the hole in which the device is mounted. A pair of spring-biased arms are mounted in respective slots in the sidewall at the opposite end from the flange. The spring arms serve to hold the device in place in the panel's hole.

The spring-biased arms are arranged to be manually rotated upward to retracted position flush with the outer surface of the device's sidewall when the device is inserted in the hole in the panel so that the arms clear the periphery of the hole. Once the device is in place within the hole the arms are pivoted outward and downward beyond the periphery of the hole on the inner side of the panel. Each arm is biased by a spring so that its free end engages a portion of the inner surface of the panel adjacent the hole, thereby securing the device in place.

While the aforementioned prior art device is generally suitable for its intended purposes, it never the less leaves much to be desired from the standpoints of simplicity of construction, effectiveness of operation (e.g., resistance to accidental loosening), ease of installation, ease of removal, and adaptiveness for mounting various types of components in various positions therein.

OBJECTS OF THE INVENTION

Accordingly, it is a general object of this invention to provide a mounting device which overcomes the disadvantages of the prior art.

It is a further object of this invention to provide a mounting device which is arranged for ease of securement within and removal from a hole in a panel.

It is still a further object of this invention to provide a mounting device arranged to be readily secured within a hole in a panel and which once secured is resistant to accidental loosening, but can be readily removed when desired.

It is still a further object of this invention to provide a mounting device which is simple in construction.

It is yet a further object of this invention to provide a device for releasable securement within a hole in a panel to mount a light bulb and reflector assembly therein.

It is yet another object of this invention to provide a device for releasable securement within a hole in a panel and having an adaptor to enable the mounting of a different sized light bulb and reflector assembly therein.

It is yet another object of this invention to provide a device for releasable securement within a hole in a panel and having an adaptor to enable the mounting of a light bulb and reflector assembly in either a retracted (recessed) position or a extended position with respect to the panel.

SUMMARY OF THE INVENTION

These and other objects of this invention are achieved by providing a device holding first means, e.g., a lamp bulb and associated reflector, for releasable mounting within a hole in a panel, e.g., a ceiling, wall, etc. The panel has first and second opposed surfaces through which the hole extends. The device comprises a body portion, a flanged portion, and releasable securement means.

The body portion is hollow for receiving the first means, e.g., bulb and associated reflector, therein and has a central longitudinal axis and a pair of end portions. The body portion is configured to be readily inserted within the hole. The flanged portion is secured to one of the end portions of the body portion and extends outward beyond the outer periphery of the body portion.

The releasable securement means comprises at least one projection having a free end portion. Each projection extends outward from the periphery of the body portion at an acute angle to the tangent of the body portion at the location from which the projection extends and is moveable from an extended position to a retracted position and vice versa. The free end portion of each projection is spaced away from the central axis by a distance greater than the radius of the hole when the projection is in the extended position, but less than the radius of the hole when in the retracted position.

Each projection is arranged to be moved from the extended position to the retracted position as the body portion is inserted within the hole by twisting the device about the axis in a first rotational direction while pushing the device into the hole. The flanged portion engages a portion of the first surface of the panel contiguous with the hole when the body portion is in a predetermined position within the hole. Each projection moves back to the extended position by the time that the body portion is in the predetermined position to hold the device in place. Once the device is in place a slight rotation of it in the opposite rotational direction from the first direction will tend to lock the device in place.

The device is readily removable from within the hole by pulling it out of the hole while twisting it about the axis in the first rotational direction, whereupon each projection moves to the retracted position.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is an isometric view, partially in section, of a device constructed in accordance with this invention shown mounted within a hole in a panel, such as a ceiling panel, for holding a light bulb and associated reflector in a retracted position therein;

FIG. 1A an isometric view of a portion of the prior art device described above showing the means for securing it in place in a hole in a panel;

FIG. 2 is a top plan view of the device shown in FIG. 1 mounted in the panel shown therein;

DETAILED DESCRIPTION OF THE PREFERRED EMBODIMENTS

Figure 3:
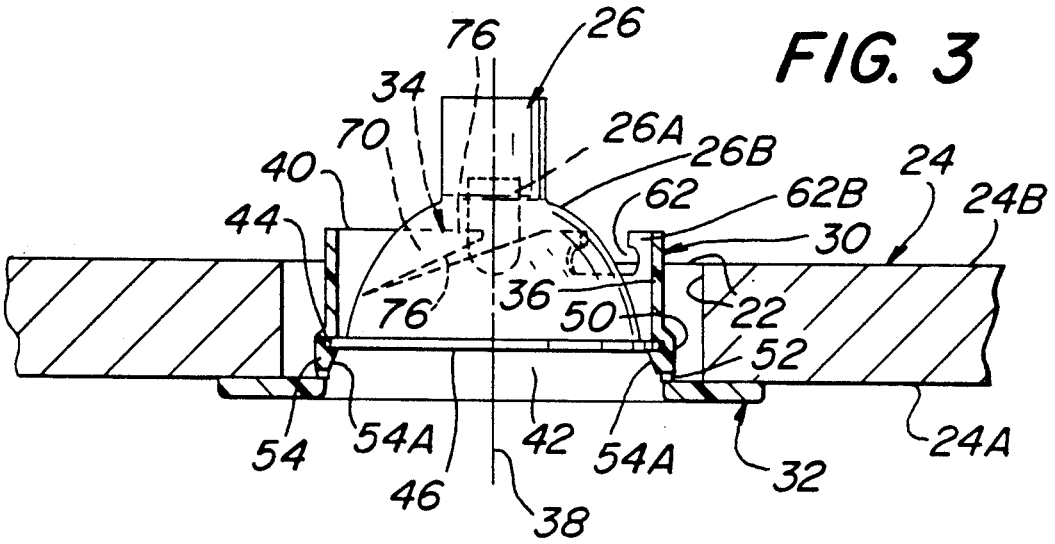
FIG. 3 is a sectional view taken along line 3—3 of FIG. 2.

Referring now to various figures of the drawing where like reference numerals refer to like parts there is shown at 20 in FIG. 1 one embodiment of the mounting device of the subject invention. The device is arranged to be releasably secured within a hole 22 within any type of panel 24, e.g., a ceiling tile, sheetrock, plaster wall, etc., quickly, easily and without the use of any special tools or techniques. In particular as will be described later the device 20 is arranged to be secured within the hole by merely inserting it therein with a twisting motion in a first rotational direction about its central longitudinal axis, whereupon the device is held firmly in place against accidental dislodging. To remove the device from the panel all that is required is to withdraw (pull) it from the hole while twisting it in the same rotational direction as used to insert it.

As can be seen in FIG. 3 the device 20 is shown holding a light bulb-reflector assembly 26 therein. In that embodiment the assembly 26 comprises a conventional, e.g., 50 or 70 watt, 12 volt, bulb 26A and an associated conventional, e.g., nominal 2 inch (5.08 cm) diameter, concave reflector 26B. When so configured the device 20 can serve as a lighting fixture for homes, offices, boats, etc. The device 20 may also be used to mount any other lighting component(s) having a suitable mounting flange (as will be described later).

While the mounting of a bulb-reflector assembly or some other lighting component is a preferred mode of utilizing this invention it is not exclusive, but rather exemplary. Thus, it must be pointed out that the device 20 can be used in any application wherein it is desired to releasably mount some component or components within a hole in a panel or to provide a liner for a hole in a panel. One example of a first of such alternative uses is to provide an internally threaded collar which can be readily secured within a hole in the panel for receiving a threaded fastener, e.g., a bolt, therein. Such a construction may serve as a substitute for conventional wall anchors or molly bolts. One example of the second of such alternative uses is to provide a collar or throughway in a panel for electrical wires, cabling, or conduits to pass through the panel.

Referring now to FIG. 1 it can be seen that the device 20 basically comprises a body portion 30, a flange portion 32, and releasable securement means 34. The body portion 30 and flange portion 32 are constructed similarly to the prior art mounting device described heretofore. Thus, as can be seen the body portion 30 is in the form of a hollow tube formed of a circular sidewall 36 encircling the longitudinal axis 38 of the device. The sidewall includes an open, inner upper end 40 at which is located the securement means 34 (to be described later) and an open, outer or lower end 42 at which the flange portion 32 is located.

The device 20 includes means for releasably mounting the bulb-reflector assembly 26 within its body 30. In particular, the inside diameter of the sidewall contiguous with end 40 is slightly smaller than the inside diameter of the sidewall contiguous with end 42 to form at the interface thereof an annular ledge 44. This ledge is arranged to receive a flange 46 extending about the periphery of the reflector 26B when the bulb-reflector assembly 26 is mounted within the device 20.

The holding means 48 are provided to releasably hold the bulb-reflector assembly 26 in place on the ledge 44 and will be described shortly.

The prior art device also makes use of means to releasably hold the bulb-reflector assembly in place on the ledge. That prior art means, however, is markedly different than the holding means 48 of this invention and basically comprises a separate snap ring (not shown) which is placed within the inner surface of the sidewall 36 on the opposite side of the reflector's flange 46 as the ledge 44 so that the flange 46 is held (sandwiched) therebetween. The snap ring is itself retained in place via plural dimples or projections (not shown) extending slightly radially inward from the inside surface of the sidewall 36 contiguous with the flange. While that prior art bulb-reflector holding means is generally suitable for its intended purposes it leaves much to be desired from the standpoints of simplicity of construction, ease of use, and resistance to loss.

The bulb-reflector assembly holding means 48 of device 20 is simple in construction and forms an integral part of the device. Thus, it cannot become separated to get lost or misplaced. To that end as can be seen clearly in FIGS. 1 and 3 the holding means 48 basically comprises at least two elongated fingers 50 located in the device's sidewall 36 adjacent the ledge 44. Each finger 50 comprises a portion of the sidewall 36 bounded by a generally U-shaped slot 52. The upper end of each finger 50 merges into the sidewall while the lower end 54 is free. Moreover, the inside surface of the lower or free end of each finger slopes slightly outward radially away from axis 38 to form a tapered tab 54A.

Each finger 50 is resilient so that its free end 54 can be flexed or bent slightly outward and upward from its normal retracted position generally flush with the sidewall 36 to an extended position (not shown). In the extended position the tab 54A of the finger is located beyond the outer periphery of the annular ledge 44 to enable the bulb-reflector assembly 26 to be inserted in place within the interior of the body of the device. In particular, this securement action is accomplished by pushing the bulb-reflector assembly 26 into the open end 42 of the body portion 30 so that it slides longitudinally inward along axis 38 until the peripheral edge of the reflector's flange 46 makes contact with the tabs 54A of the fingers 50. Continued pushing in that inward direction causes the fingers' free ends to flex outward radially until the reflector's flange passes thereby and moves into engagement with the annular ledge 44. When the reflector's flange 56 has passed the fingers' tabs, the fingers automatically flex or snap back to their original position, thereby holding the flange between the ledge and the overhanging tabs. This action securely holds the bulb-reflector assembly in place within the device against accidental removal.

Never the less the bulb-reflector assembly can be readily removed from the device when desired by merely pressing the free end of the tab 54 radially outward to disengage the surface 54A, while pulling on the bulb-reflector assembly through the device's open end.

As can be seen in FIG. 1 the interface of the sidewall 36 and the flange portion 32 includes plural radially projecting brackets 58 which are disposed at equidistantly spaced locations about the sidewall 36. These brackets serve to reinforce the flange on the body. In addition they centralize the device 20 in the hole 22. That action provides clearance to enable one to depress the tabs 54 to effect removal of the bulb-reflector assembly as described above.

As mentioned earlier the device 20 includes releasable securement means 34. This means enables the device to be readily mounted within the hole 22 in the panel 24 by merely inserting (pushing) it therein and twisting it about the axis 38 as will be described later. Once in position the device 20 is resistant to accidental disconnection from the panel. Removal of the device from the panel can be readily effected by merely pulling on the device while twisting it about axis 38 in the same direction as used to insert it in the panel.

It should be pointed out that the prior art device also includes means for securing the device within the hole 22 in the panel. However, that means, while generally suitable for its intended purpose, is not conducive to facilitating the ready removal of the device from the panel when desired as is the means 34 of this invention. In addition the securing means used in the prior art device is somewhat complex in construction, requires assembly, and is susceptible to loss of one of its components.

The foregoing drawbacks of the securement means of the prior art device will best be appreciated by reference to FIG. 1A where such means are shown. The prior art securement means basically comprises a pair of spring arms 60 (although only one is shown in FIG. 1A), each of which is mounted in a respective slot 62 in the top portion of the device's sidewall 36. The slots are located diametrically opposed to each other.

Each spring arm 60 comprises a spring section 64 and a bridging section 66. The spring section 64 is in the form of a helical compression spring which has an opposed pair of open ends 64A and 64B. The bridging section is a generally U-shaped member which bridges the ends 64A and 64B of the spring section 64. Each slot 62 is oriented horizontally and includes a pair of ears 62A and 62B projecting inward towards each other from opposite sides of the slot. Each spring arm 60 is mounted in its associated slot 62 by compressing its helical section 64 and inserting the slot's ear 62A within the spring's open end 64A and inserting the slot's other ear 62B within the spring's other open end 64B. The helical spring section is then released so that the spring lengthens to hold it in place within the slot.

With the spring arms mounted as just described each is enabled to pivot about an axis connecting the ears 62A and 62B of its mounting slot so that its U-shaped bridging section may be pivoted upward to a retracted position wherein it is located flush with the outer surface of the sidewall 36. When the spring arms 60 are in this upward (retracted) position the prior art device may be inserted into the hole 22 in the panel 24 until its flange 32 engages the outer surface 24A of the panel 24 contiguous with the hole 22. Once the end of each of the spring arms clears the periphery of the hole adjacent the inner surface 24B of the panel the arms spring outward under the bias provided by the compression spring section to an extended position. In the extended position the free end portion of each of the spring arms is located radially outward of the periphery of the hole so that it engages the inner surface 24B of the panel to hold the device in place. As mentioned earlier while this construction is generally suitable for its intended purpose of holding the device in place the use of separate spring biased arms and associated mounting slots leaves much to be desired from the standpoints of simplicity of construction, ease of use and resistance to loss of the spring arms. Moreover, the biased spring arms are not conducive to enabling the quick and easy removability of the device from within the hole.

In contradistinction the device 20 of the subject invention makes use of novel releasable securement means 34 which are simple in construction, integral with the device, and which facilitates the ready securement of the device within the hole 22 in the panel against accidental dislodging or disconnection, yet which enable the ready removal of the device from the panel when desired.

Attention is now directed at FIGS. 1, 2 and 3 where the details of this invention's releasable securement means 34 are shown. As can be seen the means 34 basically comprises a pair of extending arms 70. Any suitable number of arms may be used. As can be seen the arms are located at equidistantly spaced locations about the periphery of the sidewall 36 adjacent the open top end 40 thereof. Each arm is of generally triangular or tapered shape having an inner end 72 at which point it merges with the sidewall 36 and an outer or free end 74. The under surface 76 of each arm is inclined upward at an acute angle to a plane perpendicular to the central longitudinal axis 38 of the device to form a cam surface. This surface, as will be described later, is arranged to engage the inner surface 24B of the panel 24 contiguous with the hole 22 when the device 20 is in place therein to secure the device in that position. Each arm 70 is slightly arcuate when viewed from the top or bottom (see FIG. 2) and extends outward and backward from the periphery of the sidewall at an acute angle to the tangent of the sidewall at the location from which the arm projects.

Each arm is resilient so that it may bend or flex from an extended position to a retracted position and vice versa. The extended position is the natural, unbiased position of each arm and is shown by the solid lines in FIG. 2. Thus, as can be seen therein when the arms 70 are in their respective extended positions, their free ends 74 are located over the inner surface 24B of the panel contiguous with the hole 22. In the retracted position the arms are pivoted or flexed inward radially, like that shown by the phantom lines in FIG. 2, so that their respective free ends 74 are within the hole 22.

Each arm is arranged to be moved from its extended position to its retracted position as the body portion 30 of the device is inserted within said hole 22 to facilitate the mounting of the device in the panel. Thus, the mounting of the device within hole 22 in panel 24 is accomplished by pushing the inner end portion 40 of the device 20 into the hole from the direction of the panel's outer surface 24A while twisting the device about its central axis 38 in a first rotational direction, e.g., clockwise in FIGS. 1 and 2. This action causes the outer surface 78 of each arm 70 to engage the panel portions contiguous with the hole 22, whereupon the arms are pivoted inward to the retracted position shown in FIG. 2 so that the arms enter the hole and their outer surfaces slide on the hole's wall.

Continued pushing and twisting of the device further into the hole eventually results in the free end 74 of each arm clearing the periphery of the hole contiguous with the inner surface 24B of the panel, whereupon the natural bias of each arm causes it to start to flex outward toward the extended position. The cam surface 76 of each arm rides or slides along the inner surface 24B of the panel contiguous with the periphery of the hole as the device is pushed and twisted deeper into the hole. Eventually the flange 32 of the device engages the outer surface 24A of the panel contiguous with the hole, whereupon further insertion of the device will be halted. At this time the device will be firmly held in position in the panel by the engagement of the cam surfaces 76 of the arms on the underlying peripheral portions of the inner surface of the panel and by the engagement of the inner surface of the flange on the outer surface of the panel.

As will be appreciated by those skilled in the art the natural outward bias of the arms coupled with the fact that the surfaces of the arms which engage the inner surface of the panel contiguous with the hole are inclined ensures that the panel will always be tightly held between the arms and the flange. This renders the device resistant to accidental loosening or disconnection, making it particularly suitable for use in vibration intensive applications, e.g., on boats, in busses, etc., as well as in static structures, such as buildings. Moreover, the fact that the panel surface 76 of each arm is inclined enables the device to be used with the panels of different thicknesses, depending upon the length of the tubular body portion 36 and the angle of the surface 76.

Even though the device 20 once inserted within a hole 22 in a panel 24 is resistant to accidental loosening or dislodging, it may be readily removed from the hole when desired. That action is accomplished by grasping the flange 32 of the device and pulling it out of the hole while twisting it in the same rotational direction as used to insert it. This combined twisting/pulling action causes the arms 70 to flex inward as the cam surfaces 76 ride on the periphery of the hole 22 on the inner side 24B of the panel until the free ends 74 of the arms clear the periphery of the hole. At that time the device is free and may be completely withdrawn from the hole.

In some applications it may be desired to utilize the prior art means for securing the device 20 within the hole in the panel. To that end the device 20 includes slots 62 constructed in accordance with the prior art and adapted to receive therein prior art spring arms 60 like that shown in FIG. 1A.

Figure 4:
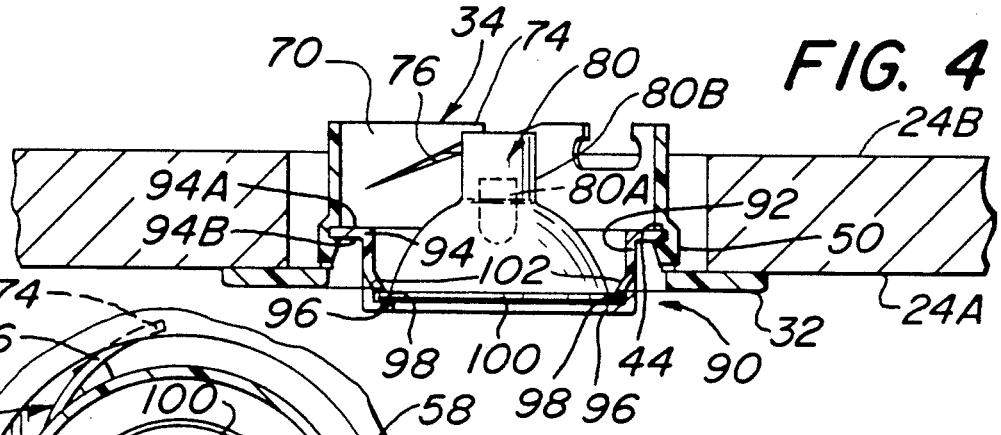
FIG. 4 is a sectional view similar to that of FIG. 3 showing the device of FIG. 2 utilizing an adaptor constructed in accordance with this invention for holding a smaller sized light bulb and reflector in an extended position.
Figure 6:
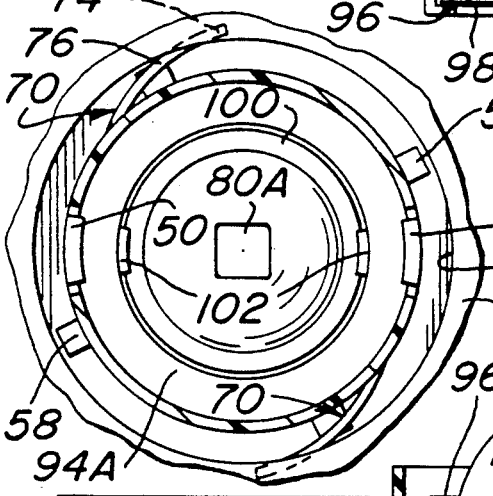
FIG. 6 is a sectional view taken along line 6—6 of FIG. 5.

In FIG. 4 there is shown the device 20 of this invention mounting a smaller bulb/reflector assembly than that of assembly 26. The smaller assembly is denoted by the reference number 80 and comprises a conventional 20 watt, 12 volt bulb 80A and a 1.385 inch (3.52 cm) diameter reflector 80B. In order to mount the assembly 80 within the device an adaptor 90 constructed in accordance with another aspect of this invention is provided.

The adaptor 90 is arranged to releasably mount the bulb-reflector assembly 80 therein and it is itself arranged to be releasably mounted within the body 30 of the device 20. The mounting of the adaptor 90 in the device 20 can be accomplished in either of two orientations or modes. In one, shown in FIG. 4 and referred to as the lower mode, the adaptor is mounted so that a portion of it extends slightly beyond the flange 32 of the device, whereupon the bulb reflector assembly is almost flush with the surface 24A of the panel. In the other orientation, shown in FIG. 5 and referred to as the upper mode, the adaptor is mounted so that it is located further into the body 30 of the device, whereupon the bulb reflector assembly is substantially recessed from the surface 24A of the panel.

The adaptor 90 is somewhat similar in construction to the body portion 30 of the device 20. Thus, the adaptor comprises a hollow tube formed of a circular sidewall 92 encircling the longitudinal axis 38 of the device. The sidewall includes at one end thereof a radially outward extending flange 94 whose outside diameter is just slightly less than the outside diameter of the ledge 44 of the device 20. The other end of the sidewall 92 includes a radially outward extending flange 96. The flange 96 includes an inner surface which serves to establish an annular ledge 98 adapted to support the flange 100 of the reflector 80B.

In order to hold the reflector in place on the ledge 98 the adaptor 90 also includes a pair of fingers !02 constructed in a similar manner to the fingers 50 described heretofore. Moreover, the fingers 102 operate like fingers 50 so that when the bulb-reflector assembly is inserted within the hollow interior of the adaptor 90 the peripheral edge of the reflector's flange 100 causes the fingers 102 to flex outward until the flange 100 clears the fingers. At that time the fingers 102 flex back to hold the reflector's flange 100 on the annular ledge 98.

The adaptor 90 is mounted within the device 20 in either the lower mode or the upper mode by inserting it through the open end 42 of the device's body 30. If the adaptor is to be in the lower mode like that shown in FIG. 4 the adaptor is inserted so that the outside surface 94A of the flange 94 faces towards the interior of the device 20. The adaptor is then pushed therein along axis 38 until the periphery of its flange 94 engages the tab 54A of the device's fingers 50. Continued pushing of the adaptor into the device causes the fingers 50 to flex outward until their tabs 54A clear the periphery of the adaptor's flange. The fingers then flex back, thereby holding the outer surface 94A of the adaptor's flange on the annular ledge 44 (like that described heretofore with respect to the mounting of bulb-reflector assembly 26 therein).

Figure 5:
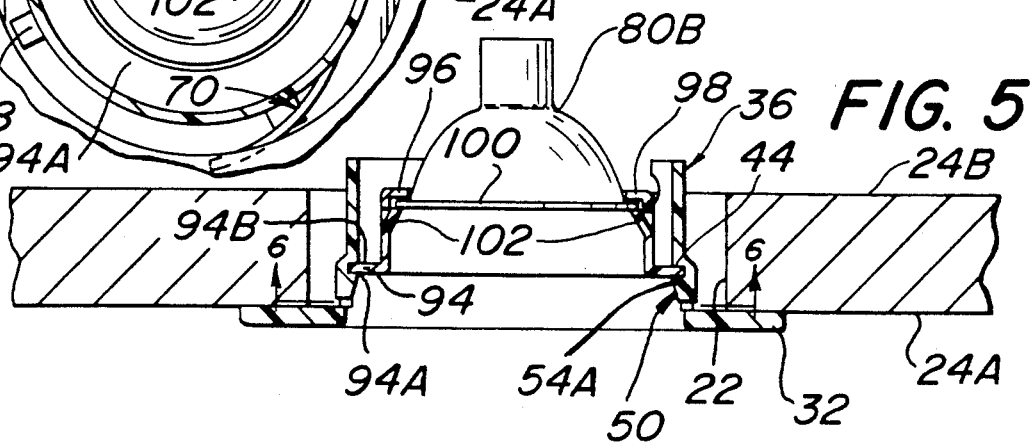
FIG. 5 is a sectional view similar to that of FIG. 4 showing the device of FIG. 2 utilizing the adaptor of FIG. 4 holding the smaller sized light bulb and reflector in a retracted position.

When the adaptor is to be mounted the upper mode like that shown in FIG. 5 the adaptor is inserted so that the inside surface 94B of the flange 94 faces towards the interior of the device. The adaptor is then pushed therein along axis 38 until the periphery of its flange 94 engages the tab 54A of the fingers. Continued pushing of the adaptor into the device causes the fingers to flex outward until the tabs clear the periphery of the adaptor's flange. The fingers then flex back, thereby trapping the outer surface 94B of the adaptor's flange on the annular ledge 44.

The device and/or adaptor can be formed of any suitable material, e.g., plastic, metal, wood, etc., or combinations thereof, depending upon the desired use/application. Moreover, the size of the device and the adaptor may be changed for use with various thickness panels, e.g., 0.5 inch (12.7 mm), 0.375 inch (9.52 mm), etc., sheetrock, or various sized components to be supported thereby.

Without further elaboration, the forgoing will so fully illustrate our invention that others may, by applying current or future knowledge, readily adopt the same for use under various conditions of service.

We claim:

1. A device for holding a first means therein and for releasable mounting within a hole in a panel, said panel having first and second opposed surfaces through which said hole extends, said device comprising a body portion, a flanged portion, and releasable securement means, said body portion being hollow for receiving said first means therein and having a central longitudinal axis and a pair of end portions, said body portion being configured to be readily inserted within said hole, said flanged portion being secured to one of said end portions of said body portion and extending outward beyond the outer periphery of said body portion, said releasable securement means comprising a projection having a free end portion, said projection extending outward from the periphery of said body portion at an acute angle to the tangent of said body portion at the location from which said projection extends and being moveable from an extended position to a retracted position and vice versa, said free end portion being spaced away from said central axis by a distance greater than the radius of said hole when said projection is in said extended position but less than the radius of said hole when in said retracted position, said projection being arranged to be moved from said extended position to said retracted position as said body portion is inserted within said hole by twisting said device about said axis in a first rotational direction while pushing said device into said hole, said flanged portion engaging a portion of said first surface of said panel contiguous with said hole when said body portion is in a predetermined position within said hole, said projection moving back to said extended position by the time that said body portion is in said predetermined position to hold said device in place, said device being readily removable from within said hole by pulling said device out of said hole while twisting said device about said axis in said first rotational direction, whereupon said projection moves to said retracted position.

2. The device of claim wherein said projection additionally comprises a cam surface extending at an acute angle to a plane perpendicular to said axis, said cam surface engaging a portion of said second surface of said panel contiguous with said hole when said body portion is in said predetermined position to hold said device securely in place within said hole at said predetermined position.

3. The device of claim 1 wherein said projection is formed of a flexible material to flex from said extended position to said retracted position and vice versa.

4. The device of claim 2 wherein said projection is formed of a flexible material to flex from said extended position to said retracted position and vice versa.

5. The device of claim wherein said hollow body portion comprises a tube having a circular cylindrical wall bounding a central passageway, said central axis extending longitudinally through said passageway, said passageway extending through said body portion between said end portions.

6. The device of claim 2 wherein said hollow body portion comprises a tube having a circular cylindrical wall bounding a central passageway, said central axis extending longitudinally through said passageway, said passageway extending through said body portion between said end portions.

7. The device of claim 3 wherein said hollow body portion comprises a tube having a circular cylindrical wall bounding a central passageway, said central axis extending longitudinally through said passageway, said passageway extending through said body portion between said end portions.

8. The device of claim wherein said first means comprises a lamp bulb, and wherein said hollow body portion additionally comprises at least one holding member for releasably securing said bulb therein.

9. The device of claim 5 wherein said first means comprises a lamp bulb, and wherein said hollow body portion additionally comprises at least one holding member for releasably securing said bulb within said passageway.

10. The device of claim 6 wherein said first means comprises a lamp bulb, and wherein said hollow body portion additionally comprises at least one holding member for releasably securing said bulb within said passageway.

11. The device of claim 9 wherein said passageway includes a ledge portion forming a supporting surface and wherein said lamp bulb is disposed within a reflector, said reflector having a peripheral flange of a first predetermined outside diameter, said flange being disposed on said supporting surface, said holding means comprises a resilient member arranged to flex into engagement with said peripheral flange of said reflector when said flange is disposed on said supporting surface to hold it in place thereon.

12. The device of claim 11 wherein said ledge portion is annular and extends about the inner periphery of said passageway.

13. The device of claim 10 wherein said passageway includes a ledge portion forming a supporting surface and wherein said lamp bulb is disposed within a reflector, said reflector having a peripheral flange of a first predetermined outside diameter, said flange being disposed on said supporting surface, said holding means comprises a resilient member arranged to flex into engagement with said peripheral flange of said reflector when said flange is disposed on said supporting surface to hold it in place thereon.

14. The device of claim 13 wherein said ledge portion is annular and extends about the inner periphery of said passageway.

15. The device of claim 1 additionally comprising an adaptor for supporting said first means within said body portion.

16. The device of claim 15 wherein said hollow body portion comprises a tube having a circular cylindrical wall bounding a central passageway and at least one holding member located within said passageway for releasably securing said adaptor within said passageway, said central axis of said device extending longitudinally through said passageway, said passageway extending through said body portion between said end portions and having a ledge, said ledge for supporting a portion of said adaptor thereon within said passageway.

17. The device of claim 16 wherein said adaptor is a tubular member having a peripheral flange of a first predetermined outside diameter, said peripheral flange being disposed on said ledge, said holding means comprising a resilient member arranged to flex into engagement with said peripheral flange of said adaptor when said flange is disposed on said ledge to hold it in place thereon.

18. The device of claim 17 wherein said ledge is annular and extends about the inner periphery of said passageway.

19. The device of claim 18 wherein said lamp bulb is disposed within a reflector, said reflector having a peripheral flange of a second predetermined outside diameter, less than said first predetermined outside diameter, said adaptor comprises a tube having a circular cylindrical wall bounding a central throat and at least one holding member located within said throat for releasably securing said reflector within said throat.

20. The device of claim 19 wherein said adaptor additionally comprises a ledge located within said throat, said ledge being arranged for supporting said flange of said adaptor thereon.

21. The device of claim 20 wherein said ledge is annular and extends about the inner periphery of said passageway.

22. The device of claim 21 wherein said holding member of said adaptor comprises a resilient member arranged to flex into engagement with said peripheral flange of said reflector when said flange is disposed on said ledge to hold it in place thereon.

23. The device of claim 22 wherein said adaptor is arranged to be mounted within said passageway in either of two orientations, one of said orientations being such that said reflector is disposed adjacent said second surface of said panel, the other of said orientations being such that said reflector is disposed further away from said second surface than in said one orientation.

24. The device of claim 2 additionally comprising an adaptor for supporting said first means within said body portion.

25. The device of claim 24 wherein said hollow body portion comprises a tube having a circular cylindrical wall bounding a central passageway and at least one holding member located within said passageway for releasably securing said adaptor within said passageway, said central axis of said device extending longitudinally through said passageway, said passageway extending through said body portion between said end portions and having a ledge, said ledge for supporting a portion of said adaptor thereon within said passageway.

26. The device of claim 25 wherein said adaptor is a tubular member having a peripheral flange of a first predetermined outside diameter, said peripheral flange being disposed on said ledge, said holding means comprising a resilient member arranged to flex into engagement with said peripheral flange of said adaptor when said flange is disposed on said ledge to hold it in place thereon.

27. The device of claim 26 wherein said ledge is annular and extends about the inner periphery of said passageway.

28. The device of claim 27 wherein said lamp bulb is disposed within a reflector, said reflector having a peripheral flange of a second predetermined outside diameter, less than said first predetermined outside diameter, said adaptor comprises a tube having a circular cylindrical wall bounding a central throat and at least one holding member located within said throat for releasably securing said reflector within said throat.

29. The device of claim 28 wherein said adaptor additionally comprises a ledge located within said throat, said ledge being arranged for supporting said flange of said adaptor thereon.

30. The device of claim 29 wherein said ledge is annular and extends about the inner periphery of said passageway.

31. The device of claim 30 wherein said holding member of said adaptor comprises a resilient member arranged to flex into engagement with said peripheral flange of said reflector when said flange is disposed on said ledge to hold it in place thereon.

32. The device of claim 31 wherein said adaptor is arranged to be mounted within said passageway in either of two orientations, one of said orientations being such that said reflector is disposed adjacent said second surface of said panel, the other of said orientations being such that said reflector is disposed further away from said second surface than in said one orientation.

33. The device of claim 2 wherein said cam surface is inclined with respect to a plane perpendicular to said longitudinal axis so that a portion of said cam surface tightly engages a portion of said second surface of said panel contiguous with said hole for any hole whose radius is within the range established by the position of said free end portion of said projection and said retracted and extended positions.

34. The device of claim 33 wherein said inclined cam surface is substantially smooth and continuous.

35. The device of claim 6 wherein said cam surface is inclined with respect to a plane perpendicular to said longitudinal axis so that a portion of said cam surface tightly engages a portion of said second surface of said panel contiguous with said hole for any hole whose radius is within the range established by the position of said free end portion of said projection and said retracted and extended positions.

36. The device of claim 35 wherein said inclined cam surface is substantially smooth and continuous.

37. The device of claim 10 wherein said cam surface is inclined with respect to a plane perpendicular to said longitudinal axis so that a portion of said cam surface tightly engages a portion of said second surface of said panel contiguous with said hole for any hole whose radius is within the range established by the position of said free end portion of said projection and said retracted and extended positions.

38. The device of claim 37 wherein said inclined cam surface is substantially smooth and continuous.

39. The device of claim 13 wherein said cam surface is inclined with respect to a plane perpendicular to said longitudinal axis so that a portion of said cam surface tightly engages a portion of said second surface of said panel contiguous with said hole for any hole whose radius is within the range established by the position of said free end portion of said projection and said retracted and extended positions.

40. The device of claim 39 wherein said inclined cam surface is substantially smooth and continuous.

41. The device of claim 24 wherein said cam surface is inclined with respect to a plane perpendicular to said longitudinal axis so that a portion of said cam surface tightly engages a portion of said second surface of said panel contiguous with said hole for any hole whose radius is within the range established by the position of said free end portion of said projection and said retracted and extended positions.

42. The device of claim 41 wherein said inclined cam surface is substantially smooth and continuous.

43. The device of claim 31 wherein said cam surface is inclined with respect to a plane perpendicular to said longitudinal axis so that a portion of said cam surface tightly engages a portion of said second surface of said panel contiguous with said hole for any hole whose radius is within the range established by the position of said free end portion of said projection and said retracted and extended positions.

44. The device of claim 43 wherein said inclined cam surface is substantially smooth and continuous.

* * * * *